United States Patent [19]

Fischer

[11] 4,171,591

[45] Oct. 23, 1979

[54] ASSEMBLY KIT AND A CONNECTING ELEMENT FOR CONNECTING STRUCTURAL ELEMENTS THEREOF

[76] Inventor: Artur Fischer, Weinhalde 34, D-7244 Waldachtal 3 (Tumlingen), Fed. Rep. of Germany

[21] Appl. No.: 824,957

[22] Filed: Aug. 15, 1977

[30] Foreign Application Priority Data

Aug. 14, 1976 [DE] Fed. Rep. of Germany ..... 2636699

[51] Int. Cl.[2] ..... A63H 33/10

[52] U.S. Cl. ..... 46/26; 46/29; 52/775

[58] Field of Search ..... 46/26, 25, 24, 23, 29, 46/31; 52/622; 35/73; 428/33

[56] References Cited

U.S. PATENT DOCUMENTS

| | | | |
|---|---|---|---|
| 1,216,840 | 2/1917 | Ramsey | 46/26 |
| 2,132,647 | 10/1938 | Robins | 46/26 |
| 2,225,612 | 12/1940 | Allen | 46/26 X |
| 2,236,926 | 4/1941 | Surface | 46/26 X |
| 2,735,146 | 2/1956 | Purviance | 46/26 X |
| 2,907,137 | 10/1959 | Ehrmann | 46/25 |
| 3,310,906 | 3/1967 | Glukes | 46/26 X |
| 3,597,873 | 8/1971 | Fischer | 46/16 |
| 4,074,496 | 2/1978 | Fischer | 46/25 X |

FOREIGN PATENT DOCUMENTS

| | | | |
|---|---|---|---|
| 2510334 | 9/1976 | Fed. Rep. of Germany | 46/26 |

*Primary Examiner*—Russell R. Kinsey
*Assistant Examiner*—Mickey Yu
*Attorney, Agent, or Firm*—Michael J. Striker

[57] ABSTRACT

An assembly kit has a hollow structural element having at least one groove inwardly of a face thereof and open to the hollow of this structural element, and a recess communicating with the groove and open at the face of this structural element. Another structural element is positionable on the first-mentioned hollow structural element and has another groove which is smaller than the groove of the hollow structural element. A connecting element is provided, which has one portion insertable in the one groove of the hollow structural element, and another portion insertable in the other groove of the other structural element so as to connect the above structural elements with one another. The connecting element has also a third portion insertable in the recess of the hollow structural element so as to prevent the connecting element from moving inwardly of the hollow of the hollow structural element.

14 Claims, 1 Drawing Figure

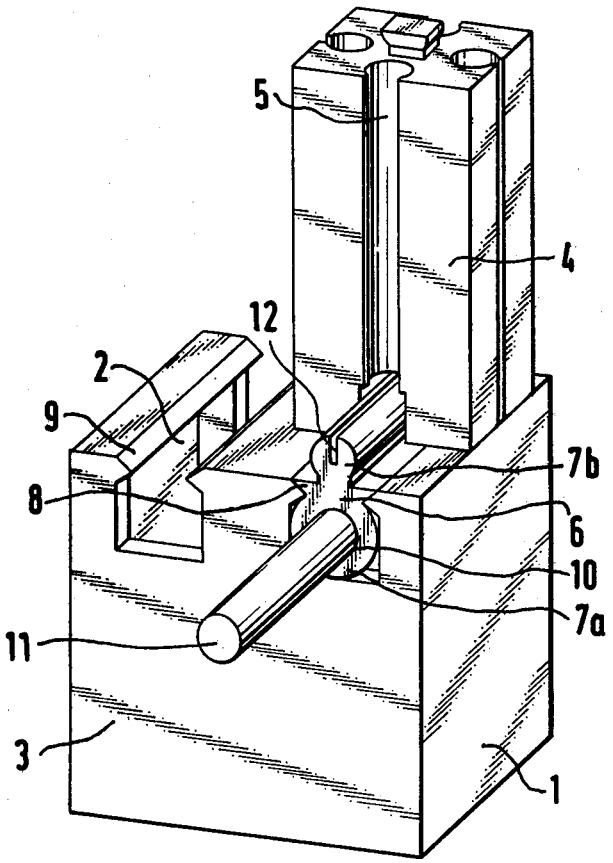
5
4
12
2
9
7b
8
6
10
7a
11
3
1

ASSEMBLY KIT AND A CONNECTING ELEMENT FOR CONNECTING STRUCTURAL ELEMENTS THEREOF

BACKGROUND OF THE INVENTION

The present invention relates to an assembly kit and a connecting element for connecting structural elements of the same. More particularly, it relates to an assembly kit which has structural elements provided with undercut grooves in which a connecting element may be inserted.

Assembly kits have been proposed in the art, including structural elements of substantially similar dimensions which are provided with undercut grooves and connected by connecting elements having undercut projections. The identically dimensioned undercut projections of the connecting element are inserted in the respective identically dimensioned grooves of the structural elements and thereby connect the latter with one another.

It has been recognized that younger children prefer to play with large structural elements connected with one another by large connecting elements which are easy to manipulate, whereas older children prefer to play with smaller structural elements and smaller connecting elements which have more diverse applications and correspond to increased manual dexterity of the older children. When the child becomes older he or she inevitably becomes interested in playing with more sophisticated assembly kits including smaller elements. At the same time, the larger structural elements and the cruder connecting elements become practically worthless for the older child. No means have been proposed in the art, enabling the child to combine the larger structural elements with the smaller structural elements so as to play with both of them.

SUMMARY OF THE INVENTION

Accordingly, it is an object of the present invention to provide an assembly kit and a connecting element of the same, which avoid the disadvantages of the prior art.

More particularly, it is an object of the present invention to provide an assembly kit in which a connecting element is so constructed as to enable a playing child to connect structural elements of different dimensions with one another.

Another feature of the present invention is to provide a connecting element for an assembly kit which can connect the structural elements of different dimensions with one another.

In keeping with these objects, and with others which will become apparent hereinafter, one feature of the present invention resides, briefly stated, in an assembly kit which has a hollow structural element having an inner groove open to the hollow of the structural element and a recess communicating with the groove and open at the face of the structural element, another structural element having another groove which is smaller than the groove of the hollow structural element, and a connecting element having one portion insertable in the one groove of the hollow structural element and another portion insertable in the other groove of the other structural element so as to connect the structural elements with one another. The connecting element has a third portion which is insertable in the recess of the hollow structural element so as to prevent the connecting element from moving inwardly of the hollow of the hollow structural element. The one portion of the connecting element has a smaller cross-sectional area than that of the other portion thereof.

The thus-constructed assembly kit and connecting element thereof give a possibility to connect the structural elements of different dimensions with one another. The connecting element whose portions are simultaneously inserted in the grooves of both structural elements connects the latter with one another. Since one of the structural elements is hollow and the other portion of the connecting element is smaller than the one portion thereof, there is a danger that the connecting element supported only by the side walls of the hollow structural element will move inwardly of the hollow of the latter. The connecting element which is constructed in accordance with the present invention prevents the above undesirable inward movement because it has the third portion which is received in the recess of the hollow structural element. A portion of a wall of the hollow structural element, which forms the above recess firmly retains the third portion of the connecting element from downward movement and thereby prevents the movement of the connecting element inwardly of the hollow of the hollow structural element.

The grooves and the recess of the structural elements are formed as undercut grooves, and the portions of the connecting element are formed as undercut members. The portions of the connecting element are elongated and extend in the direction in which the grooves and the recess of the hollow structural element extend.

Another feature of the present invention is that the recess of the hollow structural element has a cross-section increasing in the direction towards the face of the hollow structural element. The third portion of the connecting element has a cross-section corresponding to the cross-section of the recess. The recess of the hollow structural element is aligned with the one groove thereof. When the connecting element is received in the one groove of the hollow structural element the upper surface of the third portion of the connecting element is flush with the face of the hollow structural element. In this case the third portion of the connecting element does not project upwardly beyond the face of the hollow structural element and does not change the grid relationship when the smaller structural element is connected to the larger hollow structural element. The faces of the structural elements lie directly on one another so that during the connection of the structural elements with one another the grid relationship between the sizes of the structural elements, on the one hand, and the distances between the connecting means themselves and the distances of the connecting means from the outer edges on the other hand, are not changed.

Still another feature of the present invention is that at least a section of the one portion of the connecting element is tubular and has an inner bore dimensionally corresponding to the dimension of the other groove of the other structural element. Both this section of the one portion of the connecting element, and the other groove of the other structural element may be circular so that their diameters correspond to one another. An axle may be inserted in the bore of the one portion of the connecting element. Since the diameter of the bore of the one portion corresponds to the diameter of the other groove of the other smaller structural element, in an assembly kit having hollow structural elements the axles of the assembly kit having smaller structural elements may also be used.

A further feature of the present invention is that the one and the other portions of the connecting element are pin-shaped and resiliently yieldable in a direction transverse to the direction of elongation thereof. The one and the other portions of the connecting element may have slots extending in the direction of elongation thereof and imparting resilience to the above portions of the connecting element so that they may be easily inserted in the respective grooves and firmly retained therein.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

The single FIGURE of the drawing is a perspective view of an assembly kit in accordance with the present invention, showing the structural elements connected with one another by a connecting element.

DESCRIPTION OF A PREFERRED EMBODIMENT

As shown in the single FIGURE of the drawing, a hollow structural element 1 has two grooves 2 each having a cross-section increasing in the direction towards the hollow of the hollow structural element 1 and located inwardly of a face of the latter. The grooves 2 communicate with the hollow of the hollow structural element 1. For receiving an axle, each of the grooves 2 has a rectangular portion in the region of side walls 3 of the hollow structural element 1, which portion forms a continuation of the increased portion of the groove. The hollow structural element 1 further has two recesses 9 each communicating with the respective groove 2 and open at the face of the hollow structural element. The recesses 9 have a cross-section increasing in the direction towards the face of the hollow structural element 1. Each of the recesses 9 is aligned with the respective groove 2.

A smaller structural element 4 connectable with the hollow structural element 1 is provided with grooves 5 which have a cross-sectional area smaller than that of the grooves 2 of the hollow structural element 1. As clearly shown in the drawing, the grooves 5 of the second structural element 4, as well as the grooves 2 of the hollow structural element 1, are formed as undercut grooves.

A connecting element 6 has two connecting portions *7a* and *7b* connected with one another. The portion *7a* is insertable in the groove 2 of the hollow structural element 1, and the portion *7b* is insertable in the smaller groove 5 of the smaller structural element 4. Thus, the portion *7a* of the connecting element 6 has a cross-sectional area exceeding the cross-sectional area of the portion *7b* thereof. Both portions are formed as elongated members. The connecting element 6 further has a third portion 8 located between the portions *7a* and *7b* and extending substantially in the same direction. The third portion 8 has a cross-section corresponding to the cross-section of the recess 9 of the hollow structural element 1, e.g. the upwardly increasing cross-section. In this case, when the third portion 8 of the connecting element 6 is inserted in the recess 9 of the hollow structural element 1, an upper surface of the connecting element 6 is flush with the face of the hollow structural element 1. This gives a possibility to connect the smaller structural element to the hollow structural element which is enlarged with a certain grid relationship so that the latter is not changed by the thus connecting thereof.

The connecting portion *7a* of the larger cross-sectional area is formed as a tube having an inner bore 10 whose diameter corresponds to the diameter of the undercut groove 5 of the smaller structural element 4. In such a construction an axis 11 insertable in the groove 5 of the other structural element 4 may be also inserted in the bore 10 of the connecting portion *7a* of the connecting element 6 for mounting purposes.

The connecting portions *7a* and *7b* have slots 12 extending in the direction of elongation thereof so that the connecting portions are resiliently yieldable in the transverse direction. This compensates for tolerance variations in the assembly kit and gives a possibility to slightly compress the connecting portions during insertion of the latter in the respective grooves so that after the above insertion the connecting portions expand and are firmly retained in these grooves.

It will be understood that each of the elements described above, or two or more together, may also find a useful application in other types of constructions differing from the types described above.

While the invention has been illustrated and described as embodied in an assembly kit and a connecting element for connecting structural elements thereof, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An assembly kit, comprising a hollow structural element having a front wall defining one face, two pairs of circumferential walls connected with said one wall, and a wider groove which is formed substantially in one of said circumferential walls and located inwardly of said face, said wider groove extending in a first direction and being open into the hollow and at said face of said hollow structural element; another structural element having another face to be superimposed on said one face of said hollow structural element, and a narrower groove which is open at the other face and communicates with said wider groove in superimposed condition; a connecting element having a thicker elongated portion which extends in said first direction and is insertable in said wider groove of said hollow structural element, and a thinner elongated portion also extending in said first direction and insertable in said narrower groove of the other structural element so as to connect said structural elements with one another; and means for preventing said connecting element from moving inwardly of the hollow of said hollow structural element, including a recess formed in said front wall of said hollow structural element in the region of said one face and communicating with said wider groove as well as being open at said one face, and a projecting portion formed on said connecting element in the region between said thickner and thinner portions and insertable in said recess when said thicker and thinner portions are inserted in said wider and narrower grooves, said recess having a transverse cross section which increases in a direction from said wider groove toward said narrower groove whereas said projecting portion has a transverse cross section which increases in a direction from said thicker portion toward said thinner portion and corresponds to the transverse cross section of said recess.

2. The assembly kit as defined in claim 1, wherein said hollow structural element further comprises a second such wider groove adapted to receive a connecting element associated with a further structural element.

3. The assembly kit as defined in claim 1, wherein said wider groove has a cross-section increasing in the direction towards the hollow of said hollow structural element so as to form an undercut groove.

4. The assembly kit as defined in claim 1, wherein an upper surface of said projecting portion of said connecting element is flush with said one face of said hollow structural element, when said thicker portion of said connecting element is received in said wider groove of said hollow structural element.

5. The assembly kit as defined in claim 1, said recess of said hollow structural element is aligned with said wider groove thereof.

6. The assembly kit as defined in claim 1, wherein said thicker and said thinner portions of said connecting element are pin-shaped.

7. An assembly kit as defined in claim 1, wherein said recess of said hollow structural element is wider than said narrower groove of said other structural element.

8. The assembly kit as defined in claim 1, wherein said thicker and said thinner portions of said connecting elements are resiliently yieldable in a direction transverse to the direction of elongation thereof.

9. The assembly kit as defined in claim 8, wherein said thicker and said thinner portions of said connecting element each have a slot extending in the direction of elongation thereof.

10. The assembly kit as defined in claim 1, wherein said narrower groove of said other structural element is an undercut groove.

11. The assembly kit as defined in claim 10, wherein at least a section of said thicker portion of said connecting element is tubular, and has an inner bore having a dimension corresponding to the dimension of said narrower undercut groove of said other structural element.

12. The assembly kit as defined in claim 11, wherein said narrower undercut groove is circular, said inner bore of said thicker portion of said connecting element having a circular cross-section of a diameter corresponding to the diameter of said narrower undercut groove of said other structural element.

13. The assembly kit as defined in claim 11; and further comprising an axle insertable in said bore of said wider portion of said connecting element and in said narrower undercut groove of said other structural element.

14. A connecting element for connecting a hollow structural element having a face and a wider groove inwardly of the face of the hollow structural element and open to the hollow thereof, and a recess communicating with the groove and increasing in a direction toward and open at the face, with another structural element having another face to be interposed on the face of the hollow structural element, and a narrower groove which is open at the other face and communicates with the wider groove in interposed condition, the connecting element comprising a thicker portion insertable in the wider groove of the hollow structural element; a thinner portion insertable in the narrower groove of the other structural element so as to connect the structural elements with one another; and means for preventing moving of said connecting element inwardly of the hollow of the hollow structural element and including a projecting portion insertable in the recess of the hollow structural element, said projecting portion having a cross-section increasing in a direction from said wider portion toward said narrower portion of said connecting element.

* * * * *